US006340126B1

(12) United States Patent
McAlpine et al.

(10) Patent No.: US 6,340,126 B1
(45) Date of Patent: Jan. 22, 2002

(54) DEVICES AND METHODS FOR UNWINDING ELONGATE MATERIALS

(75) Inventors: Warren Welborn McAlpine; Stephen Owen Mast; David Henry Smith, all of Hickory, NC (US); Joseph Varga, Woodbridge (CA)

(73) Assignee: Corning Cable Systems LLC, Hickory, NC (US)

( * ) Notice: Subject to any disclaimer, the term of this patent is extended or adjusted under 35 U.S.C. 154(b) by 0 days.

(21) Appl. No.: 09/451,379

(22) Filed: Nov. 30, 1999

(51) Int. Cl.[7] ..... B65H 16/00; B65H 18/08; B65H 18/28

(52) U.S. Cl. ..... 242/160.2; 242/160.4; 242/165; 242/167; 242/531; 242/560; 242/603

(58) Field of Search ..... 242/160.1, 160.2, 242/160.3, 160.4, 165, 167, 420.6, 471, 531, 531.1, 559.3, 560, 602.3, 603, 602.1, 602.2; 206/391, 393, 394

(56) References Cited

U.S. PATENT DOCUMENTS

| | | | | | |
|---|---|---|---|---|---|
| 733,609 | A | * | 7/1903 | Varley | 242/603 |
| 3,339,860 | A | * | 9/1967 | Riggles | 242/602.2 |
| 3,814,338 | A | | 6/1974 | Schippers | |
| 3,836,090 | A | * | 9/1974 | Mix | 242/160.2 |
| 3,889,891 | A | * | 6/1975 | Walker | 242/560 |
| 3,997,122 | A | | 12/1976 | Helfand et al. | |
| 4,022,396 | A | | 5/1977 | Manchester et al. | |
| 4,058,264 | A | * | 11/1977 | Kawashima et al. | 242/165 |
| 4,603,817 | A | * | 8/1986 | O'Connor | 242/167 |
| 4,720,054 | A | | 1/1988 | Hood et al. | |
| 4,770,366 | A | * | 9/1988 | Hood et al. | 242/560 |
| 4,844,360 | A | * | 7/1989 | Winter et al. | 242/560 |
| 5,441,215 | A | * | 8/1995 | Nagayama et al. | 242/603 |
| 5,590,843 | A | * | 1/1997 | Greis et al. | 242/165 |
| 5,593,101 | A | | 1/1997 | Varga | |
| 5,779,226 | A | * | 7/1998 | Wadtke | 242/603 |
| 6,138,934 | A | * | 10/2000 | Helton | 242/160.2 |
| 6,209,814 | B1 | * | 4/2001 | Helton | 242/160.2 |

FOREIGN PATENT DOCUMENTS

| | | |
|---|---|---|
| DE | 19537355 A1 | 10/1995 |
| EP | 0916612 A2 | 5/1999 |

OTHER PUBLICATIONS

Patent Abstract of Japan, 56132264, Oct. 16, 1981.

* cited by examiner

*Primary Examiner*—John M. Jillions
(74) *Attorney, Agent, or Firm*—Timothy J. Aberle

(57) ABSTRACT

Devices and methods for paying off an elongate material between two coaxially aligned packages without interruption. The elongate material from a first wound package is connected to the elongate material of a second wound package by joining the tail end of the first wound package to the head end of the second wound package. Each wound package includes the elongate material having a body portion and a tail portion wound about a core. Also, each body portion has the head end at an outer diameter of the respective package and each tail portion has the tail end at an inner diameter substantially corresponding to a diameter of the core. Further, the path of the wound elongate material is transitioned from the first wound package to the second wound package by providing transition device having a supporting surface.

34 Claims, 6 Drawing Sheets

DEVICES AND METHODS FOR UNWINDING ELONGATE MATERIALS

FIELD OF THE INVENTION

The present invention relates to systems and components for paying-off an elongate material, and more particularly, to devices for transferring the pay-off of the elongate material from one rotating package to another.

BACKGROUND OF THE INVENTION

The capacity of a roll of material used in a manufacturing operation may be insufficient for a production run, which can lead to undesirable results, for example, either a residual amount of material is left on the roll or the material can be consumed before the production run has ended. In the first case, the partial roll requires extra inventory space, or it may be discarded as scrap. When the material on a roll is less than is required for a full production run, the roll may be required to be changed out, or two rolls may be spliced together one or more times during the production run. Both the roll changing and splicing operations undesirably contribute to manufacturing costs and delay.

Pay-off devices are often used to unwind or "pay-off" the material on pads, for example, armor tape used in optical cable manufacturing operations. Respective pay-off devices may hold more than one pad of material, but can require an interruption in the operation for splicing. In order to reduce the frequency of splices, and reduce the likelihood of operator error, large bulk volumes of wound tape referred to as "packages" may be used. A package is made up of many layers of tape wound along the length of a tubular core and may include side flanges.

A variable accumulator/dancer is typically positioned between the pay-off device and the production line to compensate for any substantial differences between the tape pay-off feed rate and production line tape demand rates, typically measured in feet per minute. A accumulator/dancer typically has opposing sets of rollers that the tape is fed through. One of the sets of rollers can move relative to the other set to increase or decrease the length of tape accumulated within the accumulator/dancer to account for the tape rate difference. The accumulator/dancer senses the tape feed rate from the pay-off device and, through a feedback control loop, controls the rotational speed of the pay-off to tape rate difference to a minimum.

SUMMARY OF THE INVENTION

One aspect of the present invention encompasses an unwinding apparatus. The unwinding apparatus includes a pay-off device having a motor, a brake and a shaft rotatable about a longitudinal axis, wherein the motor and the brake control the rotational speed of the shaft. The unwinding apparatus includes a transition device having a first package having a first core. The first core has an axis of rotation, the first core being mounted on a rotatable shaft having a length of a first elongate material having a tail end. The unwinding device includes a second package having a second core, the second core having an axis of rotation generally coaxially aligned with the first core axis of rotation, the second core having a length of a second elongate material having a head end. The transition device supports at least a portion of one of the elongate materials, the first elongate material being contiguous with the second elongate material by means of a connection therebetween, so that pay-off between the first and second packages occurs essentially without interruption.

Another aspect of the invention includes a package having a length of elongate material wound about a core of the package. The package includes a primary core portion and an extended core portion contiguous with the primary core portion, the extended core portion extending beyond a radial side of the package. In addition, the length of elongate material defines a body portion and a tail portion, the body portion being wound about the primary core portion, the tail portion being contiguous to the body portion and wound about the extended core portion, the length of the body portion of the elongated material being greater than the length of the tail portion of the elongate material.

DETAILED DESCRIPTION OF THE INVENTION

Figure 1:
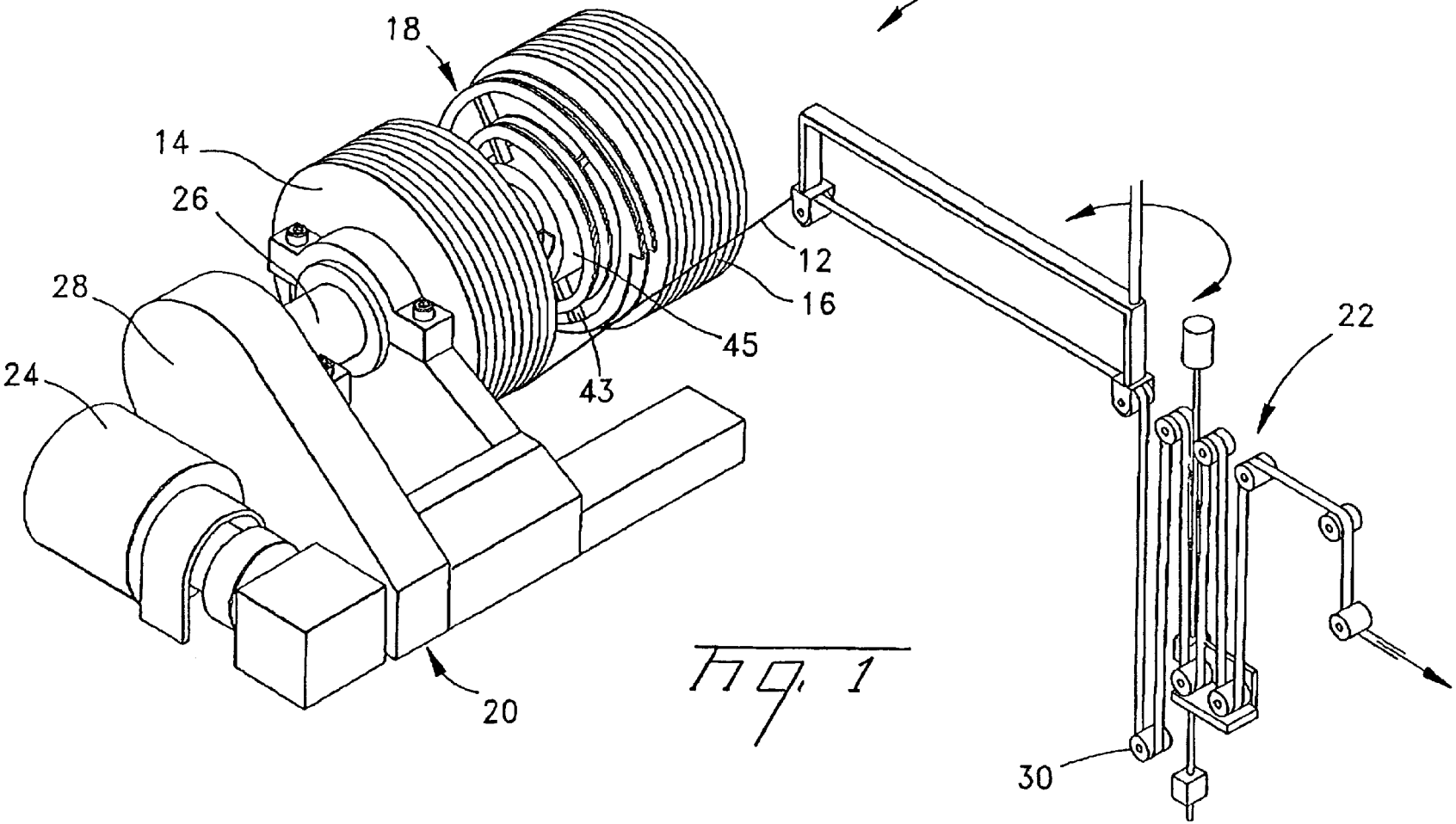
FIG. 1 is an isometric view of an exemplary unwinding apparatus according to the present invention including first and second packages of wound tape connected by a transition device, all mounted on a rotating shaft of a pay-off device feeding an accumulator dancer.

Referring to FIG. 1, an unwinding apparatus 10 according to the present invention is shown. Unwinding apparatus 10 provides for continuous pay off of an elongate material, for example, tape, glass fiber, filament, strand, wire, twine, optical ribbons, film, or cable. The elongate material can be metallic and/or non-metallic. In the preferred embodiment, the elongate material is a tape 12 extending between a first wound tape package 14 and a second wound tape package 16 transferable by a transition device 18.

Unwinding apparatus 10 further includes a pay-off device 20 that rotates the first and second packages 14 and 16 to feed tape 12 into a variable accumulator or dancer 22. In the manufacture of optical fiber cable, for example, dancer 22 transfers tape 12 to a production line that wraps the tape around the optical fibers to protect the fibers from damage. To avoid stopping or slowing the production line, transition device 18 transfers the unwinding of tape 12 from package 14 to package 16 in a gradual manner. Unwinding apparatus 10 controls tension in the tape by way of transition device 18 providing a tape-supporting surface that progresses from the level of the end of tape 12 at a core of first package 14, to the outer diameter of second package 16.

Pay-off device 20 includes a motor 24 for driving a rotatable shaft 26 that mounts the first and second packages 14 and 16 and transition device 18. Rotatable shaft 26 includes conventional, releasable locking mechanisms (not shown) that secure packages 14, 16 and transition device 18 to the shaft to prevent their rotation relative to the shaft. The respective locking mechanisms are preferably independently releaseably lockable. The pay-off also includes a conventional braking mechanism 28 to slow or stop the rotation of shaft 26.

Figure 2:
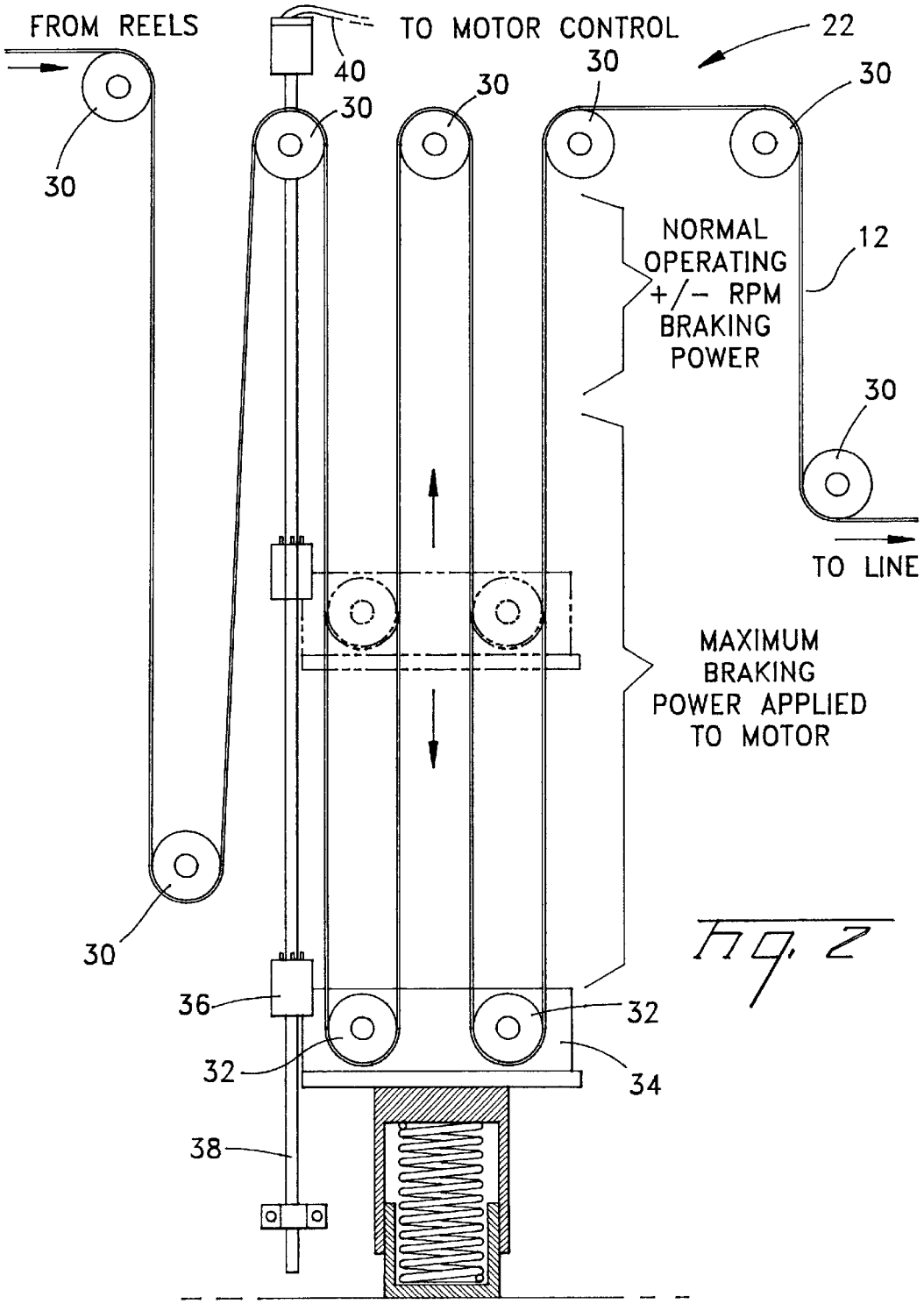
FIG. 2 is a front view of the dancer of FIG. 1.

Referring to FIG. 2, tape 12 is fed from pay-off device 20 and is received by accumulator/dancer 22, which includes a series of rollers 30 that guide the tape to the production line (not shown). Within rollers 30 are opposing sets of rollers that provide dancer 22 with the capacity to accumulate a given length of tape 12. Increasing the number of and distance between opposing rollers increases the accumulation capacity of dancer 22. Preferably, rollers 30 include at least one variably-mounted roller 32 (two are shown in the Figures) having a distance to its opposing roller that varies with the incoming rate of tape 12 to enable dancer 22 to accommodate differences between the outgoing and incoming rates of tape. Each of rollers 30 and 32, for example, includes a rotatable body mounted by bearings onto a shaft. Additionally, rollers 32 are mounted on a movable block 34, which may be weighed down, such that when the incoming tape rate is less than the outgoing tape rate, the distance to the opposing rollers decreases. In contrast, when the incoming tape rate is greater than the outgoing tape rate, the distance to the opposing rollers increases. A sensor 36, which may ride along a shaft 38, is connected to block 34 and senses the relative position of rollers 32. A signal is sent via signal wire 40 representing the relative position to motor 24 to control the rotational speed of shaft 26 to adjust the rate of tape 12 being fed to dancer 22 so that the pay-off rate is at least generally commensurate with the demand rate.

Figure 3:
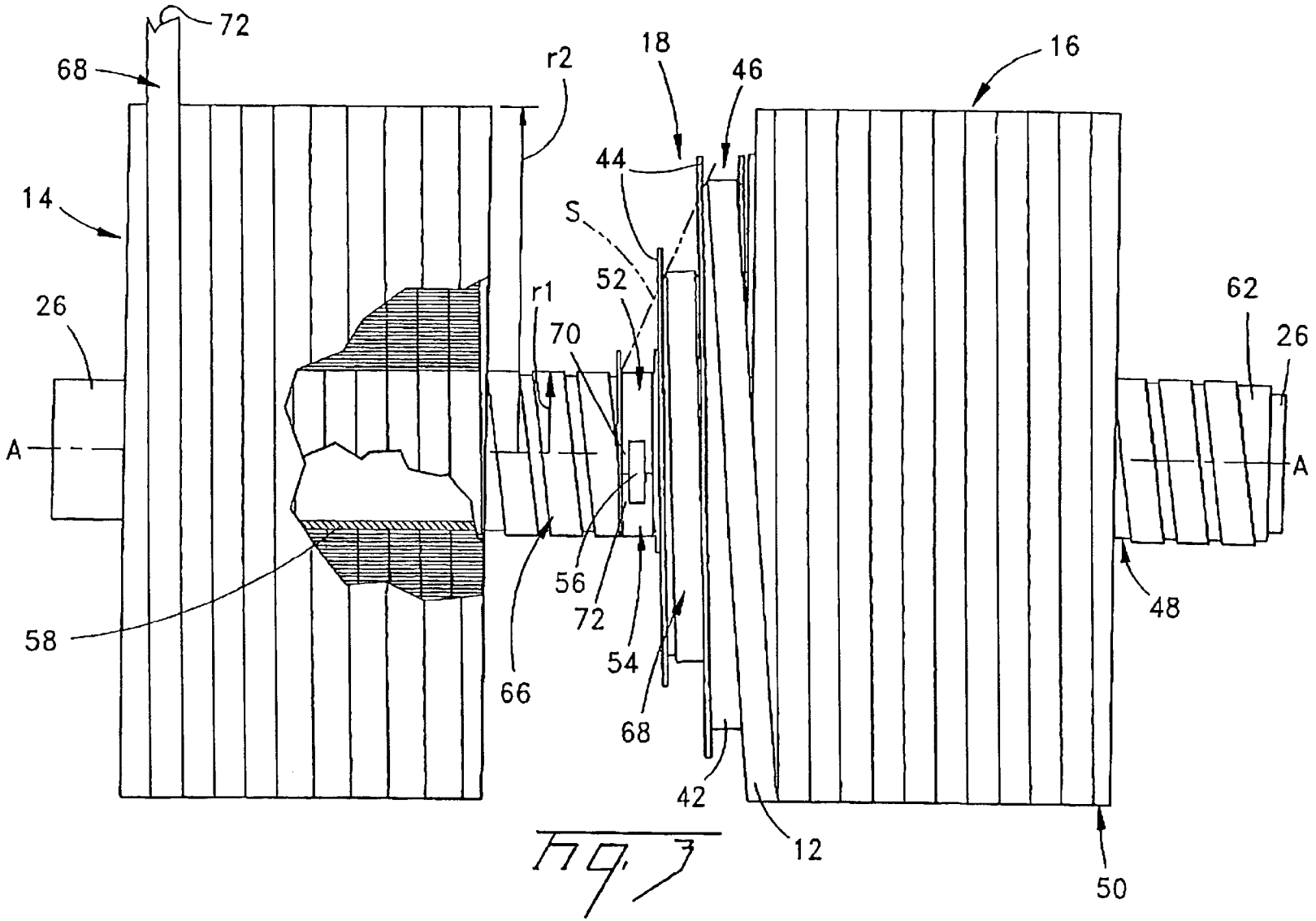
FIG. 3 is a front view of the first and second packages and transition device mounted on the rotating shaft of the pay-off device, with a partial cross-sectional view of the first package.

Referring to FIGS. 1 and 3, one embodiment of transition device 18 comprises an elongated surface 42 arranged in the form of a generally conical helix to support tape 12. The generally conical helix progresses along a slope S (FIG. 3). Surface 42 of transition device 18 is preferably supported by a plurality of spoke members 43 (FIG. 1) radially extending from a cylindrical hub member 45, which is mountable onto shaft 26. Transition device 18 may also include a side wall 44 extending from each edge of surface 42 to form a tape-receiving channel 46 to contain tape 12. At least one flange 44 is preferably positioned on the cone apex-side of surface 42 to contain tape 12 on the surface, as the tension in tape 12 urges the tape toward the apex of the conical helix. Alternatively, instead of a continuous flange 44, spaced apart extending members such as pins or intermittent flange portions may be utilized. The conical helix surface 42 gradually and generally helically ramps from a first radius $r_1$, (FIG. 3), substantially corresponding to the distance from the axis of rotation A—A to the level of the core 48 of a package, to a second radius $r_2$, substantially corresponding to the distance from the axis of rotation A—A to the level of the outer tape diameter 50 of a package. Surface 42 may be substantially parallel to axis A—A, or the surface may be at an angle relative to axis A—A.

Transition device 18 advantageously provides a path for tape supporting surface 42 that is longitudinally extended along axis A—A (FIG. 3). This path allows the elongated supporting surface 42 to act as an accumulator for a length of tape 12, where the accumulation capacity may be increased by increasing the longitudinal length of transition device 18. Further, the accumulation capacity of transition device 18 is affected by the slope S of the conical helix (FIG. 3), where a more gradual slope exists, relative to axis A—A, a greater capacity is provided by increasing the total length of the path. Preferably, the generally helical path of surface 42 is longitudinally extended such that adjacent surfaces do not overlap. The elimination of overlapping portions of surface 42 advantageously allows tape 12 to be supplied from one point on the surface without interference from another portion of the surface, thereby preventing damage to or breakage of the tape.

Figure 4:
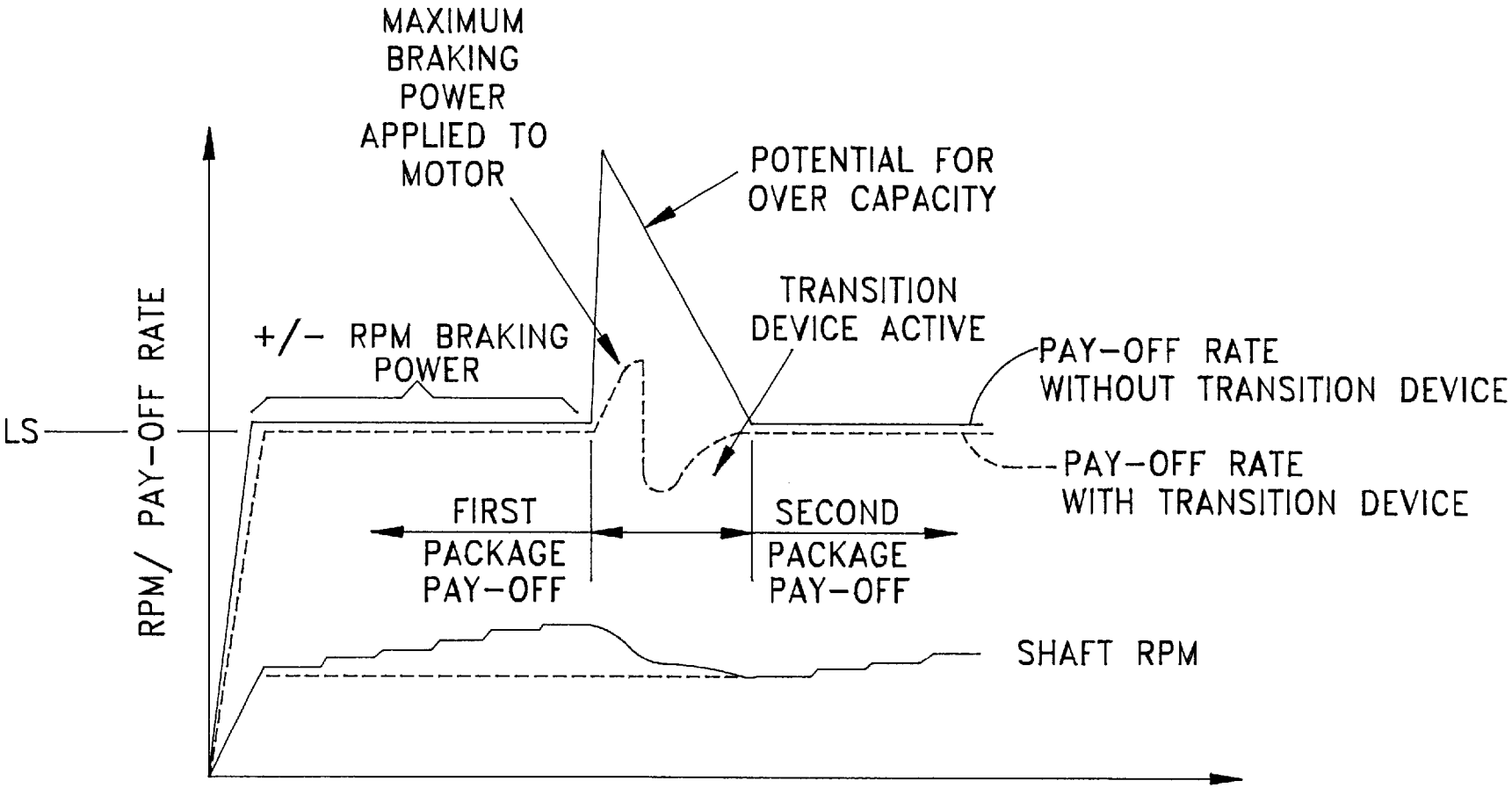
FIG. 4 is a graph generally representing the shaft rotations per minute (rpm's) and the corresponding pay-off rate of the tape with and without the transition device.

Referring to FIG. 4, transition device 18 advantageously provides a smooth transition of tape 12 from first package 14 to second package 16 so that the tape is ultimately integrated into the cable product at a normal line speed rate LS. The accumulator/dancer keeps the tape feed at the normal rate LS during pay of the first package with a controlled +/− variation. When the transition device is active, the gradual change of the radius of surface 42, combined with the accumulation capacity, allows time to reduce the rotations per minute (rpm's) of shaft 26 and packages 14 and 16. The change in rpm is done by applying maximum braking power to the rotatable shaft or motor. The pay-off rate from the packages initially climbs above, falls below, and then again attains the LS rate during pay off of the second package (FIG. 4). Transition device 18 advantageously allows variable roller 32 to accumulate and then dispense the tape thereby eliminating the potential for a huge over capacity of the tape and avoiding any impact on the cable product. Further, the gradual change improves the tension control during the transfer. By transferring tape 12 from the end of one package to the beginning of another package, transition device 18 advantageously allows all of the tape on a package to be utilized, thereby eliminating waste and extra cost. Additionally, by enabling the use of connected bulk packages, transition device 18 reduces the number and frequency of required splicing, thereby saving time. Further, transition device 18 increases safety by reducing handling of the tape.

When joining together tape 12 from packages 14 and 16 through transition device 18, the tail end 52 of the tape from one package is joined to the head end 54 of tape from the beginning of the other package with a splice 56 (FIG. 3). Suitable types of splices 56 include, for example, welding, heat seal, tape, glue, and soldering. In order to load tape 12 into transition device 18, preferably enough tape is unwound from each package 14 and 16 to allow an operator to make splice 56 between ends 52 and 54. Preferably package 14 is held stationary while package 16 is rotated to take up any slack. Spliced tape 12 is then positioned within channel 46 from a first end of transition device 18, corresponding to the first radius $r_1$, to a second end of transition device 18, corresponding to the second radius $r_2$. Tape 12 is tightened against surface 42 by using the engageable locking mechanism (not shown) of pay-off device 20 to selectively secure one package relative to shaft 26, and then rotating the transition device 18 and the other package. Tape 12 is thereby supported by surface 42 during the entire transition from first package 14 to second package 16.

Figure 5:
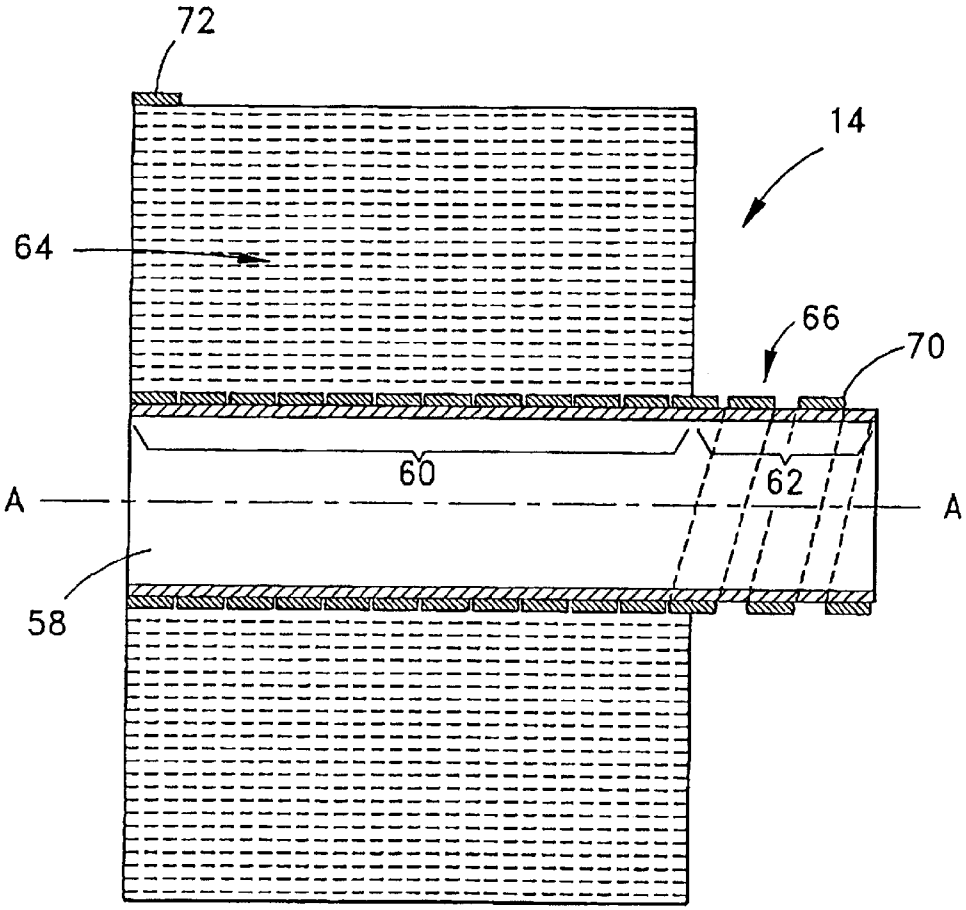
FIG. 5 is a cross-sectional view of the first package.

In a traditional package, the tail end 52 of the wound tape is covered by the outer windings, making it difficult or impossible to unwind the tail without first unwinding the entire package. However, referring to FIG. 5, package 14 preferably includes a core 58 having a primary core portion 60 and an extended core portion 62. Body portion 64 of the length of tape 12, which is substantially the entire length of the tape, is wound in a plurality of layers about the primary core portion 60. Tail portion 66 of tape 12, which is a length of the tape at the end of the package, is wound about extended core portion 62. Tail portion 66 of one package is thereby separately unwindable from core 58 to permit joining with a head portion 68 (FIG. 3), which is a length of tape at the beginning or outer diameter of body portion 64 of another package. For example, tail portion 66 may be of a length that allows an operator to position together the end of the tail portion of one package and the end of the head portion 68 of another package to operate a welding machine to make splice 56. Preferably packages 14 and 16 are essentially identical at the beginning of a run. However, more than two packages can be placed side by side on shaft 26 with respective transition devices disposed therebetween for a continuous feed of material in seriatim from the packages. In winding tape 12 about core 58, a tail end 70 of the tape is first positioned on the core and a first layer of tape is wound about the entire length of the core. A plurality of intermediate layers of tape 12 is then wound only about the primary core portion 60. Therefore, a total length of the tape 12 on a package 14 or 16, from tail end 70 at core 58 substantially corresponding to first radius $r_1$, to a head end 72 at the outer diameter of the body portion 64 substantially corresponding to second radius $r_2$, is preferably continuously wound about the core 58. Although tail portion 66 of tape 12 has been described as being wound about the extended core portion 62, one skilled in the art would realize that the tail portion may be otherwise accessible.

Transition device 18 may be fabricated from metal, plastic or any other suitable material. Although described with surface 42 and a tape-receiving channel 46 supported by spoke and hub members 43 and 45 (FIG. 1), transition device 18 can be formed, for example, from a solid or partially hollow material with an integral support surface.

Figure 6:
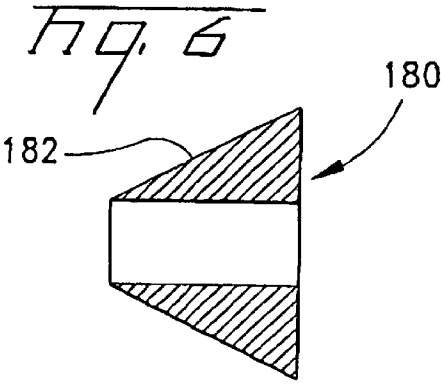
FIG. 6 is an alternative embodiment of a transition device with a conical surface.
Figure 7:
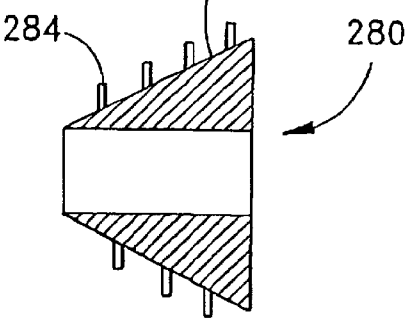
FIG. 7 is an alternate embodiment of a transition device with a conical surface and retaining members.
Figure 8:
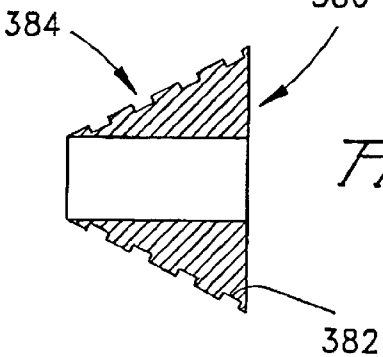
FIG. 8 is an alternative embodiment of a transition device with a conical surface having grooves.

Further, although transition device 18 has been described as a conical helix surface 42, other similar configurations may provide a gradual tape transition from one package to another. Referring to FIG. 6, for example, a transition device 180 includes a conical support surface 182 formed in a solid or hollow configuration . In this embodiment, tape 12 (not shown) may be removeably held in place on the surface 182 by, for example, partial welding, tacking down or gluing. In another embodiment, referring to FIG. 7, a transition device 280 includes a generally conical support surface 282 having one or a plurality of retaining members 284 along a generally helical path radially extending outward from the surface. Retaining members 284 may include, for example, a continuous flange, segments of spaced-apart flanges, or a plurality of pins. In another embodiment, referring to FIG. 8, a transition device 380 may comprise a conical support surface 382 having a generally helical tape-receiving channel 384.

Figure 10:
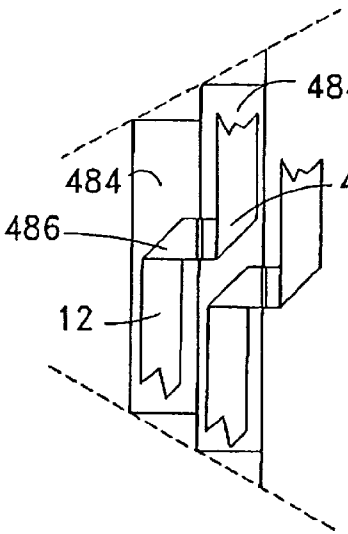
FIG. 10 is a top view of the tape transition from one step to the next in the transition device of FIG. 9.
Figure 9:
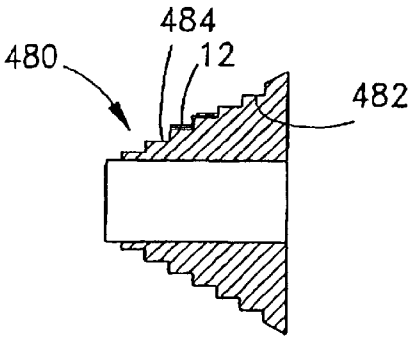
FIG. 9 is an alternative embodiment of a transition device having a stepped conical surface.

In yet another embodiment, referring to FIG. 9, a transition device 480 comprises a stepped, tape-receiving surface 482 in the form of a series of steps of increasing diameter. To transition from one step to the next, referring to FIG. 10, tape 12 may be wrapped completely around a perimeter 484 of one step, including a lateral fold 486 (FIG. 10) so that the tape runs to the next step, then a lateral fold 486' is made for wrapping around the next perimeter 484'. Each fold is, for example, partially welded, tacked, glued or otherwise removeably held in place on the surface 482. The steps can be formed in a monolithic device 480 or a series of discs.

Figure 11:
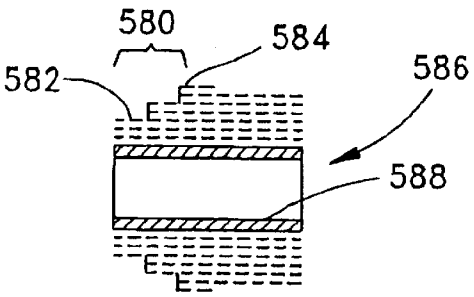
FIG. 11 is an alternative embodiment of a transition device having a support surface formed by the layers of the tape windings.

In yet another embodiment of the present invention, referring to FIG. 11, a transition device 580 has a support surface 582 that is formed by the tape windings 584 of package 586. In this embodiment, the longitudinal length of each layer of tape 12 wound onto core 588 is controlled to provide the desired surface 582, such as a stepped conical surface.

Although the invention has been described with reference to the preferred embodiments, other embodiments can achieve the same results. As such, variations and modifications of the present invention will be apparent to one skilled in the art and the following claims are intended to cover all such modifications and equivalents. For example, the extended core portion can take the shape of a radially extending flange of the package. The flange can have a spiral formed therein that functions as the transition device. The inventions described herein can be used to pay off essentially any elongate material in a factory or field environment. Where the package comprises flanges one flange can include a slit from the core to the outside diameter of the flange to accommodate the transition of the elongate material to the transition device and second package.

What is claimed is:

1. A package having a length of elongate material wound about a core of the package, comprising:

a primary core portion and an extended core portion contiguous with the primary core portion, the extended core portion extending beyond a radial side of the package; and, the length of elongate material defining a body portion and a tail portion, the body portion being wound about the primary core portion, the tail portion being contiguous to the body portion and helically wound about the extended core portion so that sections of the tail do not overlap, the length of the body portion elongated material being greater than the length of the tail portion of the elongate material.

2. The package of claim 1, wherein the elongate material comprises a head end and a tail end such that the length of the elongate material is continuous from the head end to the tail end, wherein the head end is part of the body portion and the tail end is part of the tail portion.

3. The package of claim 1, wherein the elongate material is a strip of material.

4. The package of claim 3, wherein the strip of material comprises an armor tape.

5. The package of claim 3, wherein the strip of material comprises a metallic tape.

6. The package of claim 3, wherein the strip of material comprises paper.

7. The package of claim 6, wherein the paper comprises non-soluble paper.

8. The package of claim 6, wherein the strip of material comprises non-woven plastic.

9. A system for unwinding an elongate material, comprising:

a first package of a first length of an elongate material wound about a first longitudinal axis, the first length of elongate material having a first head end contiguous with a first tail end thereof;

a second package of a second length of the elongate material, the second length being wound about a second longitudinal axis, the second longitudinal axis being generally coaxially aligned with the first longitudinal axis, the second length of the elongate material having a second head end contiguous with a second tail end thereof; and, a supporting surface comprising a generally cone shaped configuration operative to transition at least one of the first and second elongate materials during a pay off operation, the supporting surface supporting at least one of the first and second elongate materials, the supporting surface transitioning the elongate material between a first radius of the supporting surface proximate the coaxially aligned axes, and a second, distal radius of the supporting surface by generally helically winding the elongate material about the generally cone shaped configuration.

10. The system of claim 9, wherein the supporting surface has a first end adjacent to the first package and a second end adjacent to the second package, wherein the supporting surface further comprises a generally helical flange about the cone.

11. The system of claim 10, wherein a longitudinal spacing of the helical flange forms elongate material-receiving grooves.

12. The system of claim 9, wherein the cone has a first end adjacent to the first package and a second end adjacent to the second package, and wherein the cone further comprises a generally helical groove to receive elongate material extending from the first end to the second end.

13. The system of claim 9, wherein the supporting surface comprises a plurality of discs of different diameters forming a stepped cone.

14. The system of claim 9, wherein the supporting surface comprises a generally conical helix strip having a first end and an opposing second end, wherein the first end is at the first radius and the second end is at the second radius.

15. The system of claim 14, wherein the conical helix strip further comprises at least one wall extending from an edge of the strip.

16. The system of claim 15, wherein the conical helix strip further comprises side edges and walls extending from the side edges to form a channel.

17. The system of claim 16, wherein the surface is substantially parallel to the longitudinal axis.

18. The system of claim 9, wherein at least one of the first and second packages further comprises:

a core longitudinally extending to form a primary core portion and an extended core portion; and a corresponding one of the first and second lengths of elongate material is wound about the core to form a body portion and a tail portion, the body portion wound about the primary core portion, the tail portion connected to the body portion and wound about the extended core portion, a first total length of the body portion is greater than a second total length of the tail portion, and wherein the tail portion is unwindable from the core separately from the body portion.

19. The system of claim 9, wherein the supporting surface is formed by the windings of the second length of elongate material of the second package.

20. A transition device, comprising:

a first package having a first core, the first core having an axis of rotation, the first core being mounted on a rotatable shaft having a length of a first elongate material having a tail end;

a second package having a second core, the second core having an axis of rotation generally coaxially aligned with the first core axis of rotation, the second core having a length of a second elongate material having a head end; and an elongate material-receiving transition device, wherein the device comprises a generally conical helix channel supporting at least a portion of one of the elongate materials, the first elongate material being contiguous with the second elongate material by means of a connection therebetween, so that pay-off between the first and second packages occurs essentially without interruption.

21. The apparatus of claim 20, wherein the channel is longitudinally extended along the shaft such that adjacent portions of the channel do not overlap.

22. An unwinding apparatus, comprising:

a pay-off device having a motor, a brake and a shaft rotatable about a longitudinal axis, wherein the motor and the brake control the rotational speed of the shaft;

a first package mounted on the shaft, the first package including a first body portion and a first tail portion of a first elongate material and a first core, the first body portion connected to the first tail portion and both portions wound about the first core;

a second package mounted on the shaft, the second package comprising a second body portion and a second tail portion of a second elongate material and a second core, the second body portion connected to the second tail portion and both portions wound about the second core;

wherein the first tail portion of the first package is connected to the second body portion of the second package;

a transition device having a surface generally forming a conical helix supporting at least a first portion of the first elongate material or a second portion of the second elongate material, wherein the level of the support surface transitions the elongate material from the first tail portion to the second body portion; and an accumulator having an accumulation capacity for the first and second elongate material, the accumulator receiving one of the first and second elongate material from the pay-off device, the accumulator including a sensor for determining the incoming rate of the first and second elongate material, the sensor providing a feedback signal to the pay-off device to control an incoming rate of one of the first and second elongate material.

23. The apparatus of claim 22, wherein the first core further comprises a primary core portion and an extended core portion, the first body portion wound about the primary core portion and the first tail wound about the extended core portion.

24. The apparatus of claim 22, further comprising a splice connecting the first tail portion and the second body portion, wherein the first portion of the first elongate material and the second portion of the second elongate material are adjacent to the splice.

25. The apparatus of claim 22, wherein the surface includes edges and at least one side wall extending from one of the edges.

26. The apparatus of claim 22, wherein the first elongate material and the second elongate material are tape.

27. The apparatus of claim 26, wherein the tape is metallic.

28. The apparatus of claim 26, wherein the tape is plastic.

29. A method of joining elongate material for unwinding, comprising:

connecting the elongate material from a first wound package to the elongate material of a second wound package by joining the tail end of the first wound package to the head end of the second wound package, wherein each package includes the elongate material having a body portion and a tail portion wound about a core, each body portion having the head end at an outer diameter of the respective package and each tail portion having the tail end at an inner diameter substantially corresponding to a diameter of the core; and transitioning the path of the wound elongate material from the first wound package to the second wound package by providing a supporting surface generally forming a conical helix that transitions from a first position substantially corresponding to the diameter of the core of the first wound package to a second position substantially corresponding to the outer diameter of the second wound package.

30. The method of claim 29, further comprising mounting the first and second packages adjacent to one another about a longitudinal axis.

31. The method of claim 30, further comprising extending the supporting surface along the longitudinal axis such that adjacent portions of the supporting surface do not overlap.

32. The method of claim 31, wherein the supporting surface further comprises a stepped cone.

33. The method of claim 29, further comprising winding the tail portion of the first package about an extended portion of the core and winding the body portion of the first package about a primary portion of the core.

34. The method of claim 29, wherein the elongate material is tape.

* * * * *